United States Patent [19]

Devine et al.

[11] 4,111,280

[45] Sep. 5, 1978

[54] SUPPORTING GUIDE RAIL FOR LADDER SAFETY DEVICE

[75] Inventors: Donald R. Devine, La Habra; William L. Gardiner, Anaheim, both of Calif.

[73] Assignee: Norton Company, Worcester, Mass.

[21] Appl. No.: 763,979

[22] Filed: Jan. 31, 1977

[51] Int. Cl.[2] ..... E06C 7/18; A62B 1/16

[52] U.S. Cl. ..... 182/8

[58] Field of Search ..... 182/3, 4, 5, 6, 7, 8, 182/191, 10, 11, 36

[56] References Cited

U.S. PATENT DOCUMENTS

| | | | |
|---|---|---|---|
| 607,161 | 7/1898 | Conaway | 182/5 |
| 2,616,609 | 11/1952 | Herod | 182/8 |

*Primary Examiner*—Reinaldo P. Machado

*Attorney, Agent, or Firm*—Walter Fred

[57] ABSTRACT

A fall prevention safety climbing device for workmen ascending and descending ladders on tall structures comprises a sleeve including a locking pawl adapted for attachment to a workman's safety belt, movable along a continuous supporting guide rail fixed to a ladder and for automatic locking engagement with the supporting rail to arrest a workman's fall. The supporting guide rail is provided at predetermined intervals with notched sections adapted to allow disengagement in a specific safe manner of the otherwise entrapped sleeve and attached climber from the supporting guide rail. Hence, a climber can disembark at the desired platform, or level of the structure to allow another climber to pass on by to another level and thereafter reconnect himself and the attached sleeve to the supporting guide rail.

7 Claims, 5 Drawing Figures

SUPPORTING GUIDE RAIL FOR LADDER SAFETY DEVICE

BACKGROUND OF THE INVENTION

1. Field of Invention

The invention relates to a fall prevention safety device for protecting persons climbing ladders on tall structures and particularly to an improved supporting guide rail attached to the ladder which allows the climber to safely connect as well as disconnect himself and an automatic locking sleeve to and from the support rail at predetermined desired levels of the structure.

2. Description of the Prior Art

There are various safety climbing devices adapted for attachment to ladders by various types of support cables and rails slideably engaged by a locking clamp or sleeve including a locking pawl attached to a safety belt about the climber. Many of the locking clamps are attachable and removable at any point along the support cable or rail as disclosed in U.S. Pat. Nos. 2,553,438, 3,179,994, 3,979,797 and 3,908,791. However, others such as disclosed in U.S. Pat. Nos. 2,538,904, 2,616,609, 3,348,632 and 3,523,591 are not and must be threaded on and off the supporting guide rails at the opposite ends thereof.

The instant invention is directed to provide an improved supporting guide rail for use in combination with substantially the type of safety clamp or sleeve disclosed and described in U.S. Pat. No. 2,616,609 granted to Herod and to which reference may be had for details not disclosed hereinafter. Specifically, the applicant's invention provides a continuous supporting guide rail made up of a plurality of aligned sections some of which are placed at predetermined desired intervals and adapted to allow the clamping sleeve assembly or unit to be safely attached to and detached from the supporting guide rail only at predetermined sites or platforms by the person ascending or descending the ladder. Hence, the improved supporting guide rail allows a climber to disembark with his clamping assembly attached to his safety belt at predetermined sites or elevated platforms along the ladder or structure. Further, it allows the climbers and their attached clamping sleeve assemblies to pass one another along the ladder.

SUMMARY OF THE INVENTION

A fall prevention device for protecting persons climbing and descending ladders on tall structures comprises an improved continuous supporting guide rail made up of a plurality of interconnected sections fixed to the ladder and movably engaged by a clamping sleeve assembly attachable to the climber of substantially the type disclosed in U.S. Pat. No. 2,616,609 incorporated herein by reference. The improved supporting guide rail of circular cross sectional shape is made up of relatively long tube sections fixed to the climbing device or ladder and one or more relatively shorter tubular or solid sections interposed between them at certain predetermined intervals. Means are provided only on the relatively shorter sections for connecting and disconnecting the clamping sleeve to and from the supporting guide rail in a predetermined specific manner which retains the safety factor and prevents accidental disengagement.

The shorter supporting guide rail section is notched out to provide at least one but preferably a pair of axially spaced clearance slots or notches of predetermined depth with which the similarly spaced cylindrical upper main and auxiliary lower bearing parts of the clamping sleeve assembly must be aligned with and pushed into before rotation of and lateral removal of the sleeve from the guide rail can be accomplished. Rotating the sleeve assembly approximately 90° aligns the guide way receiving channel or slot in each of the bearing parts with the remaining spaced narrow portions which include circular segments and guide strip portions of the guide rail adjoining the spaced clearance slots. The sleeve is then disengaged by shifting it laterally to pass by the remaining narrow portion of the guide rail through the guide way receiving slot. Thus, the sleeve remains connected to the guide rail and climber until he is safely at his destination or an adjacent platform along the way.

Therefore, the primary object of the invention is to provide an improved continuous supporting guide rail for ladder climbing safety devices that allows the connection and disconnecting of a clamping sleeve and attached climber to and from the supporting guide rail only at predetermined sites and in a particular safe manner.

DESCRIPTION OF THE PREFERRED EMBODIMENT(S)

Figure 1:
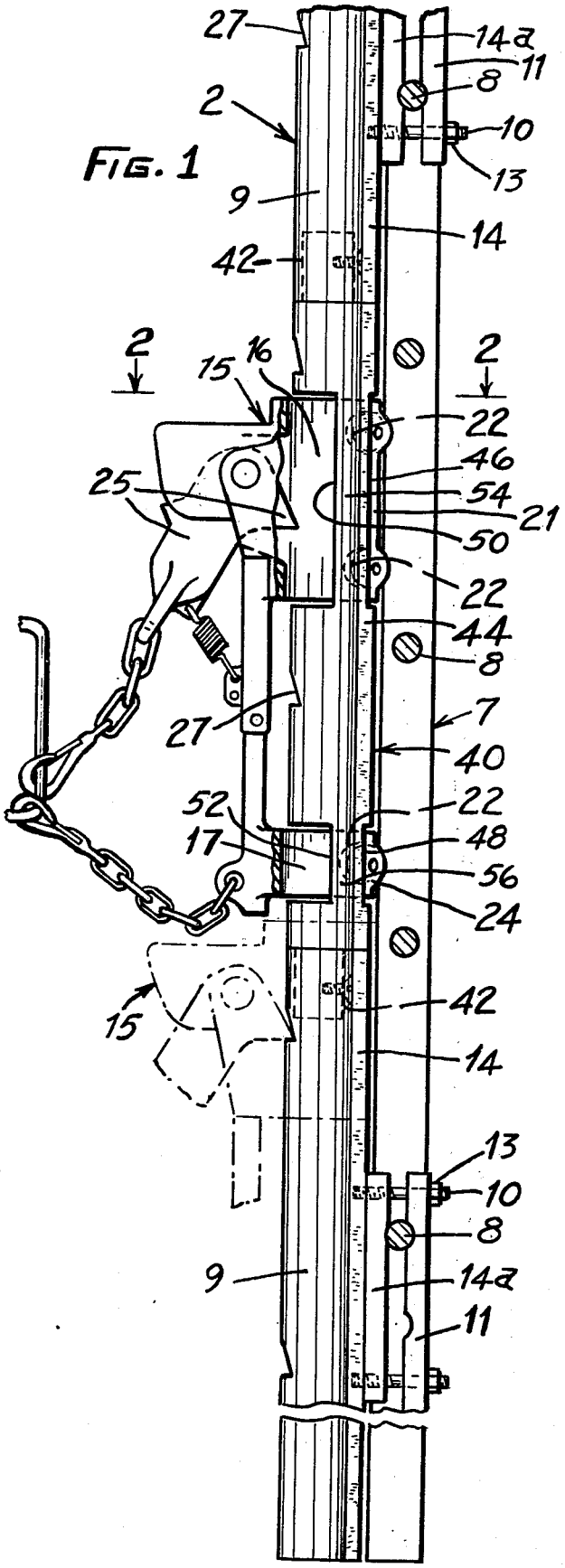
FIG. 1 is a side elevation of a portion of the continuous supporting guide rail of the invention showing a movable safety clamping sleeve assembly thereon aligned with notches in a section adapted to allow engagement and disengagement of the sleeve at a predetermined elevation in a particular manner.

Referring to the drawings there is shown a fall prevention safety device including an improved continuous supporting guide rail assembly 2 fixed to a ladder 7 as by clamping to rungs 8 of the ladder. The guide rail assembly is adapted for sliding and rolling engagement with a generally cylindrical split tubular clamping sleeve assembly 15 substantially identical in construction to the sleeve assembly 15 disclosed and described in U.S. Pat. No. 2,616,609 granted to Herod and to which reference may be had for details not disclosed herein.

The improved continuous supporting guide rail assembly 2 is comprised of a number of interconnected tubular or solid long sections 9 and relatively shorter tubular or solid notched section 40 of generally the circular cross sectional configuration of the tube 9 shown in the above mentioned U.S. Pat. No. 2,616,609. The tube sections 9 are securely fixed to the rungs 8 of the ladder 7 by bolts or studs 10 fixed to and extending from the guide rail tube 9 through clamping plate 11 and conventional securing means such as nuts 13.

Each section 9 has suitably fixed thereto as by bolting or welding, a channel bar or guide strip 14 which coacts with a stepped portion or spacer 14a and the clamping plate 11 to secure the supporting guide rail section 9 to the rungs 8 of the ladder 7. The guide strip or channel bar 14 projects into elongated guide way receiving channels or slots 21 and 24 in the bearing parts of the sleeve 15, to prevent rotation of, and maintain the bearing parts or rollers 22 in a predetermined contact position on the supporting guide rail.

The shorter tubular or solid notched section 40 of the guide rail assemmbly 2 is of substantially identical circular cross sectional shape and diameter as the tube section 9 but has reduced opposite end portions or couplings 42 fixed thereto of a diameter suitable to fit snugly into a bore and fastened as by screws to the end portion of adjacent sections 9. A short notched out channel bar or guide strip 44 is fixed to the section 40 and extends in alignment with and to the ends of the guide bar 14 on the tubes 9. The guide strip 44 has a long shallow notch and recessed surface 46 in an upper portion thereof axially spaced from a relatively shorter shallow notch or recess 48 of substantially the same depth in a lower portion of the section 40.

Likewise, the diametrically opposite or front side of each notched section 40 has an upper long deeply notched out portion and recessed surface 50 axially spaced from a lower relatively shorter deeply notched out portion and recessed surface 52.

The upper opposing long notches and recessed surfaces 46 and 50 are axially aligned substantially parallel to one another and the longitudinal axis thereof and extend axially a distance greater than the axial length of the upper main bearing part 16 of the sleeve 15. Likewise, the lower opposing shorter recessed or notched out surfaces 48 and 52 are axially aligned substantially parallel to one another and the longitudinal axis thereof and have an axial length greater than the axially aligned lower auxiliary bearing part 17 on the sleeve assembly.

Equally spaced along the front side of the supporting guide rail assembly 2 are a plurality of relatively shallow pawl engaging notches 27 adapted to receive and engage the end portion of the locking pawl or detent 25 pivotally mounted on the main bearing part 16. Thus, it can be seen that regardless of the shorter notched out section 40 the sleeve assembly 15 attached to the safety belt of a person ascending or descending the ladder can move freely axially along the supporting guide rail 2 and arrest the fall of the person attached in the same manner taught in the above mentioned U.S. Patent granted to Herod. However, the shorter sections 40 provide additional means whereby the climber and attached sleeve 15 can be connected to as well as disconnected from the rail assembly 2 only at predetermined spaced sites or platforms situated at different levels along the structure or ladder.

Figure 2:
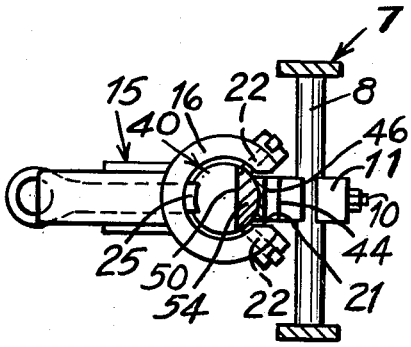
FIG. 2 is a cross sectional view taken on line 2—2 of FIG. 1 showing the configuration and relationship between the various elements.

Disengagement of the sleeve assembly 15 from the supporting guide rail is accomplished by the person to which it is attached by first aligning the bearing parts 16 and 17 in the center of the corresponding adjacent notched out portions 50 and 52 as shown in FIGS. 1 and 2. In this position the locking pawl 25 is spring biased further into the notch and will engage the bottom of the notch 50 in the event the climber falls.

Figure 3:
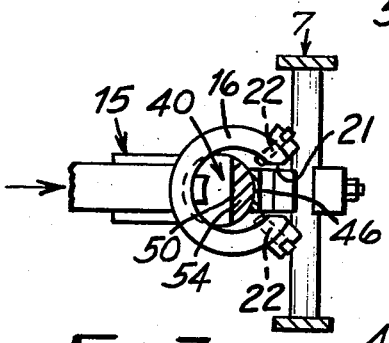
FIG. 3 is a partial cross sectional view showing the sleeve bearing parts aligned with and pushed laterally into the notches to clear the guide rail and permit partial rotation of the sleeve.
Figure 4:
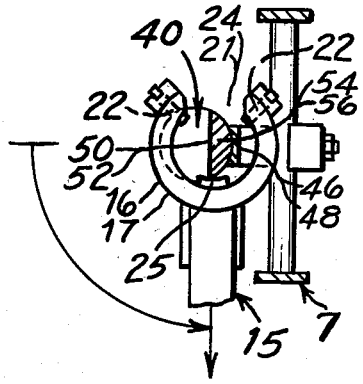
FIG. 4 is a partial cross sectional view showing the sleeve rotated approximately 90° and the guide way rail receiving channel therein aligned for passage therethrough of the remaining narrow portions of the notched section of the supporting guide rail during the lateral movement and final disengagement of the sleeve therefrom.
Figure 5:
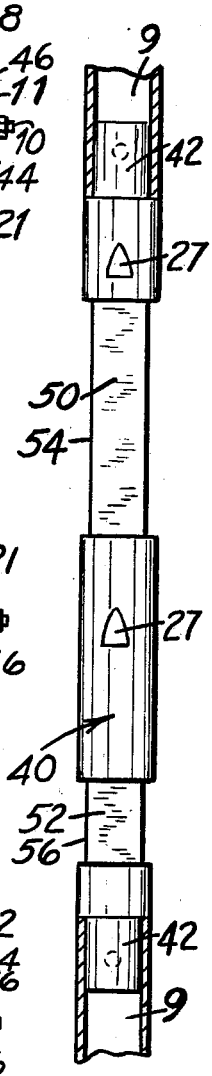
FIG. 5 is a front elevation partially in section of a portion of the supporting guide rail showing one of the shorter notched sections situated between and interconnected to other sections of the continuous supporting guide rail.

Secondly, the sleeve bearing parts 16 and 17 are simultaneously forced into the notches until the hinged connected bars 18 and 19 engage the front of the supporting guide rail section 40 and the rollers are clear of the notched out portions 46 and 48 of the guide way strip or bar 44 as shown in FIG. 3. Thirdly, the sleeve is rotated approximately 90° either clockwise or counterclockwise as shown in FIG. 4 to align the wider guide strip receiving channels or openings 21, 24 for passage therethrough of the remaining narrower portions of the section 40 including the circular segments 54 and 56 and adjacent portions 46 and 48 of the guide strip. In the rotated and aligned position the sleeve 15 can be completely removed laterally while still attached to the climber whom by this time is usually safely situated on an adjacent structure or platform.

It can be seen that the remaining narrower portions, between the notches in the circular portion and adjacent guide strip, have a thickness less than the width of the guide strip receiving channel 21 and a width greater than its thickness but less than the maximum diameter of the circular portion of the notched section 40. Thus, the sleeve can only be removed after rotating and aligning the channel 21 therein with the thickness or smallest dimension and narrowest part of the remaining narrower portion.

Obviously, reconnection of the sleeve to the support rail 2 requires a procedure opposite to that for disengagement and it is therefore deemed unnecessary to describe the procedure for reengagement thereof.

Alternatively, the clamping sleeve utilized may have but one bearing part and therefore the section 40 need only have a single notch instead of two as disclosed herein above in the preferred embodiment of the invention. Additionally, the supporting guide rail may be curved or have a combination of curved and straight sections 9 and 40 connected together or made of a single integral bar or tube with the desired notches cut therein.

As many possible modifications may be made of the invention described herein above, it is to be understood that the invention includes all embodiments and modifications thereof falling within the scope of the appending claims.

What is claimed is:

1. A continuous supporting guide rail for a ladder climbing safety device of the type securable to the ladder comprising a clamping sleeve assembly movable axially along the supporting guide rail including at least one tubular bearing part having a wall extending circumferentially around beyond the diameter of an engaging circular portion of the supporting guide rail to opposite sides of a guide strip receiving channel of predetermined width in the wall whereby the sleeve is held and prevented against rotation by a guide strip on the supporting guide rail, a locking pawl pivotally connected to the bearing part for locking engagement with the supporting guide rail, means for connecting the locking pawl and sleeve to a safety belt of a person ascending or descending the ladder whereby the sleeve assembly is normally moved along the supporting guide rail by the person but which immediately forces the locking pawl into locking engagement with the supporting guide rail in the event the person falls from the ladder wherein the improvement comprises:

notched means situated on and between opposite ends of the continuous supporting guide rail for allowing the sleeve assembly to be selectively displaced radially into and out of guiding engagement with the guide strip, rotated into and out of alignment with the guide strip and displaced laterally by the notched means for connecting and disconnecting the sleeve assembly to and from the supporting guide rail in a predetermined relatively safe manner.

2. A continuous supporting guide rail according to claim 1 wherein the notched means comprises:

a notched section having at least one narrow portion, of predetermined thickness less than the width of the channel including a circular segment of the circular portion and an adjacent portion of the guide strip, adjoining a relatively deep notch in the circular portion of sufficient radial depth and axial length to allow the bearing part of the sleeve assembly to be displaced radially into the deep notch and sufficiently out of engagement with the guide strip to allow partial rotation of the sleeve assembly, alignment of the channel with the narrow portion and passage of the sleeve assembly by the narrow portion adapted to pass through the channel.

3. A supporting guide rail according to claim 2 wherein each notched section comprises:

a pair of the narrow portions axially spaced to provide upper and lower narrow portions adjoining upper and lower relatively deep notches in the circular portion of sufficient radial depth and axial length to allow a clamping sleeve assembly with spaced axially aligned upper main and lower auxiliary bearing parts and guide strip receiving channels therein to be displaced radially into the upper and lower notches and sufficiently out of engagement with the guide strip to allow partial rotation of the sleeve assembly, alignment of the guide strip receiving channels with the upper and lower narrow portions and passage of the sleeve assembly by the upper and lower narrow portions adapted to pass through the channels in the upper and lower bearing parts.

4. A supporting guide rail according to claim 3 wherein the notched section further comprises:

a shallow notch in the guide strip opposite each of the relatively deep notches in the circular portion.

5. A supporting guide rail according to claim 4 further comprising:

a plurality of pawl engaging notches in and spaced longitudinally along a peripheral side of the circular portion of the supporting guide rail opposite the guide strip.

6. A continuous supporting guide rail according to claim 5 wherein each of the narrow portions is wider than its predetermined thickness and the width of the channel but not as wide as the maximum diameter of the circular portion.

7. A continuous supporting guide rail according to claim 6 comprising:

a plurality of sections of predetermined length including at least one notched section and other sections assembled together to form the continuous supporting guide rail, and coupling means for interconnecting the notched section and the other sections of the supporting guide rail together in axial alignment.

* * * * *